US008517903B2

(12) United States Patent
Bassi

(10) Patent No.: US 8,517,903 B2
(45) Date of Patent: Aug. 27, 2013

(54) MACHINE AND METHOD FOR MAKING CURVILINEAR PACKING BOXES

(75) Inventor: Gino Bassi, San Giovanni in Persiceto (IT)

(73) Assignee: Emmeci S.p.A., Milan (IT)

( * ) Notice: Subject to any disclaimer, the term of this patent is extended or adjusted under 35 U.S.C. 154(b) by 825 days.

(21) Appl. No.: 12/303,576

(22) PCT Filed: Jan. 21, 2008

(86) PCT No.: PCT/IB2008/000163
§ 371 (c)(1),
(2), (4) Date: Dec. 5, 2008

(87) PCT Pub. No.: WO2008/090455
PCT Pub. Date: Jul. 31, 2008

(65) Prior Publication Data

US 2010/0173763 A1 Jul. 8, 2010

(30) Foreign Application Priority Data

Jan. 23, 2007 (IT) ..... BO2007A0034

(51) Int. Cl.
*B31B 1/00* (2006.01)

(52) U.S. Cl.
USPC ..... 493/155; 493/82; 493/306; 493/391

(58) Field of Classification Search
USPC ..... 493/82, 84, 155, 158, 305, 306, 296, 493/164, 391
See application file for complete search history.

(56) References Cited

U.S. PATENT DOCUMENTS

| | | | | |
|---|---|---|---|---|
| 2,661,790 | A * | 12/1953 | Slaughter | 156/423 |
| 2,737,862 | A * | 3/1956 | Thull | 493/112 |
| 3,126,798 | A * | 3/1964 | Fairchild | 493/109 |
| 3,134,307 | A * | 5/1964 | Loeser | 493/135 |
| 4,072,226 | A | 2/1978 | Richards et al. | |
| 4,292,102 | A | 9/1981 | Bidegain | |
| 4,452,596 | A * | 6/1984 | Clauss et al. | 493/107 |
| 5,954,624 | A * | 9/1999 | Sandstrom | 493/158 |
| 5,992,489 | A * | 11/1999 | Busse | 156/443 |
| 7,381,176 | B2 * | 6/2008 | Graham et al. | 493/84 |

FOREIGN PATENT DOCUMENTS

| | | |
|---|---|---|
| EP | 0 011 550 | 5/1980 |
| FR | 2 330 533 | 6/1977 |

OTHER PUBLICATIONS

International Search Report dated Aug. 4, 2008, from corresponding to PCT application.

* cited by examiner

*Primary Examiner* — Sameh H. Tawfik
(74) *Attorney, Agent, or Firm* — Pearne & Gordon LLP

(57) ABSTRACT

A machine for making covered paper or cardboard boxes which have a curvilinear outline includes elements for forming a curvilinear box (6) and a covering station (R) operating in conjunction with elements for the linear feed of a pre-glued covering sheet (12), in such a way that the sheet (12) is connected to the outer wall of the box (6).

14 Claims, 8 Drawing Sheets

MACHINE AND METHOD FOR MAKING CURVILINEAR PACKING BOXES

TECHNICAL FIELD

The present invention relates to an automatic machine for forming and covering paper or cardboard packing boxes which have a curvilinear outline.

BACKGROUND ART

Prior art devices for forming curvilinear boxes usually consist of machines which assemble a body consisting of a cylindrical wall with a separate bottom having the same outline and which is normally joined to the wall by gluing.

Covering the boxes consists of subsequent application of a layer of covering paper which gives the end product the desired outer finish.

However, prior art machines have several disadvantages in the automatic production of high quality covered boxes, that is to say, in which in the finished box the presence of separate parts, such as the base and the cylindrical wall cannot easily be seen or felt.

A second disadvantage is the fact that it is not possible to automatically and efficiently perform the entire processing of a covered curvilinear box, starting with assembly of the separate parts, the bottom and the wall, up to covering of the finished product.

DISCLOSURE OF THE INVENTION

A first aim of the present invention is to overcome the problem of automatic production of covered paper or cardboard boxes which have a curvilinear, preferably circular shape.

A second aim of the invention is to propose a machine and method for automatically making covered paper or cardboard curvilinear boxes with high productivity and at the same time able to make high quality boxes.

The technical purpose indicated and the aims specified are substantially achieved by a machine and method for making boxes comprising the features described in one or more of the claims herein.

BRIEF DESCRIPTION OF THE DRAWINGS

Further features and advantages of the present invention are more apparent in the detailed description below, with reference to a preferred, non-limiting, embodiment of the invention, illustrated in the accompanying drawings, in which.

DETAILED DESCRIPTION OF THE PREFERRED EMBODIMENTS OF THE INVENTION

With reference to the accompanying drawings, a machine is described for making curvilinear boxes 6, obtained starting with a curvilinear cylindrical wall 1 connected to a bottom or base 2.

It should be noticed that according to the present invention, the wall 1 may be made from pre-formed tubes, or may be formed in a line in a suitable operating station upstream of the machine.

Figure 11:
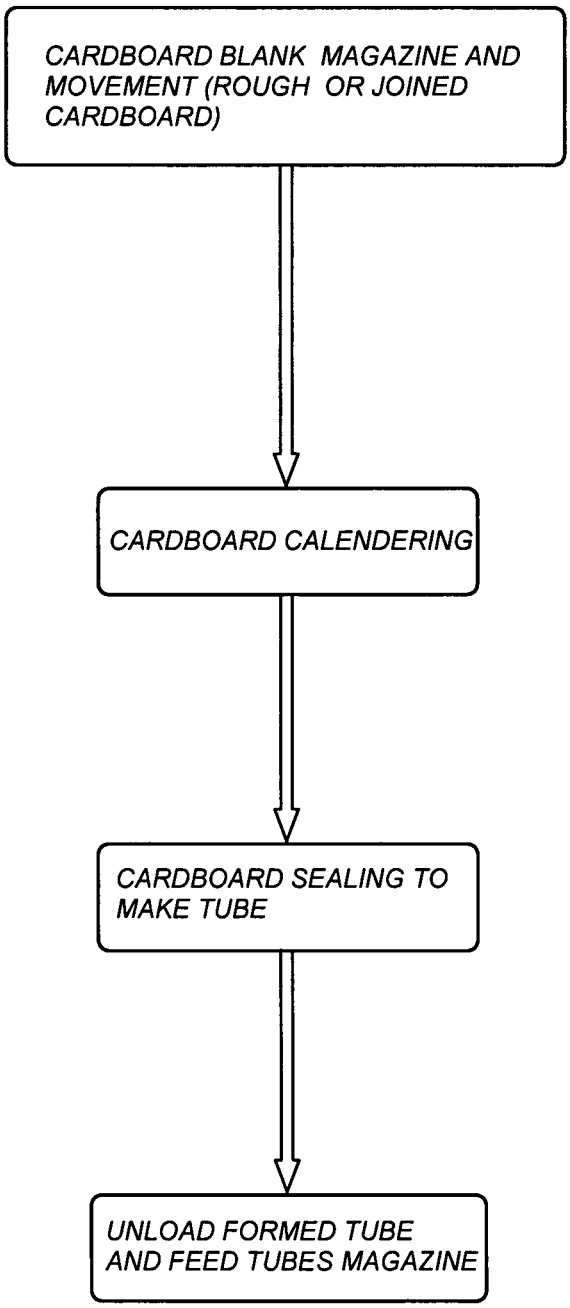
FIG. 11 shows a succession of steps for the in line production of tubes intended to constitute the wall of cylindrical boxes.

In the example in FIG. 11, a station for forming cylindrical tubes may have, one after another, a cardboard blank (rough or joined) magazine from which the cardboard, having dimensions equal to the length of the box to be formed, is picked up and moved to a calendering station in which the tube is formed by sealing the free ends of the cardboard.

Once the cylindrical tube has been formed, it is unloaded and fed to a finished tubes magazine.

Figure 1:
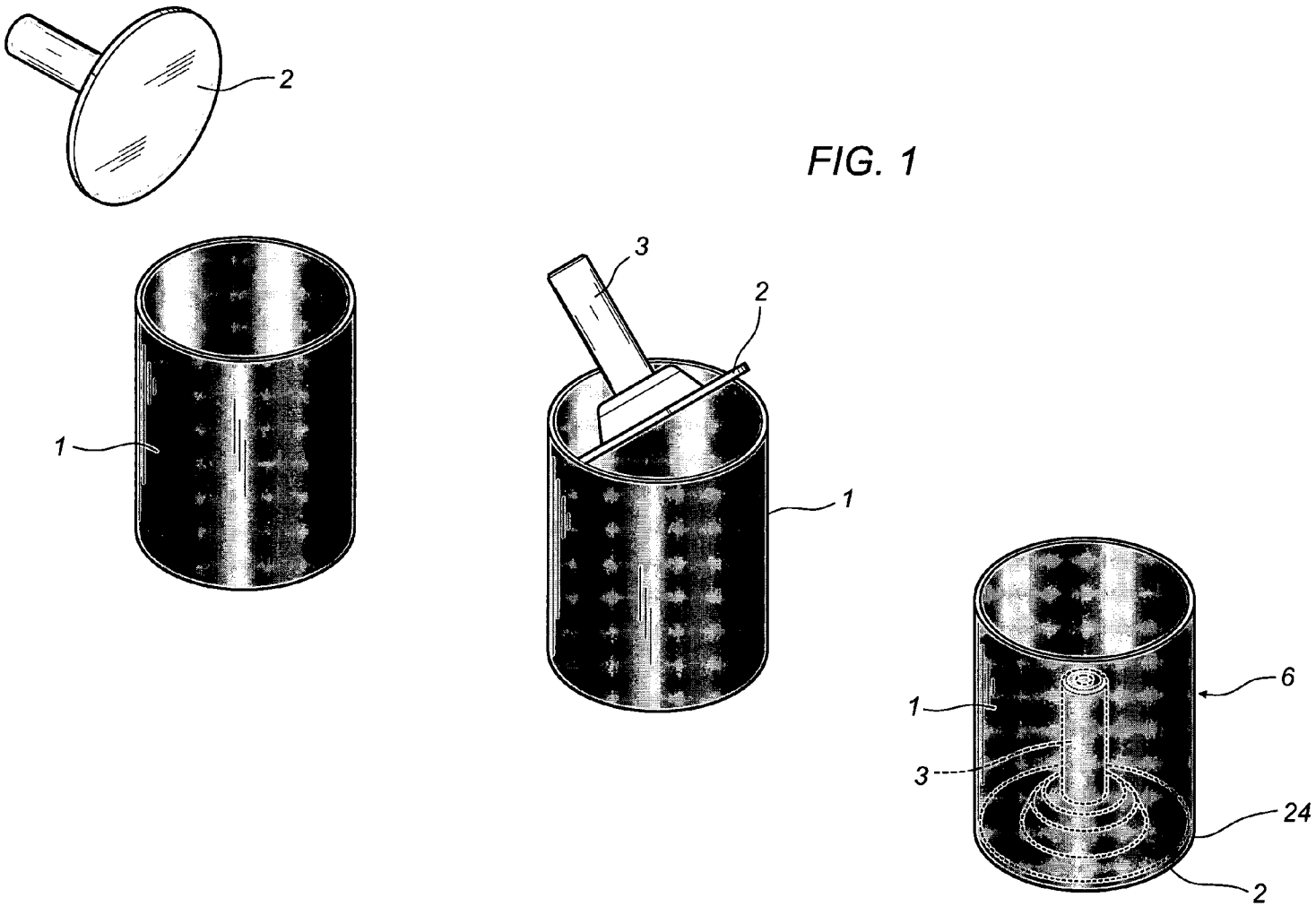
FIG. 1 is a schematic view of steps for assembling a curvilinear wall with a base.

Preferably, and with reference to FIG. 1, the box 6 has a circular outline, and is obtained by inserting the bottom 6 in a wall having a round cross-section 1 using a gripper element 3, for example of the suction cup type, until one end 24 of the wall is closed by mechanical interference.

Figure 2:
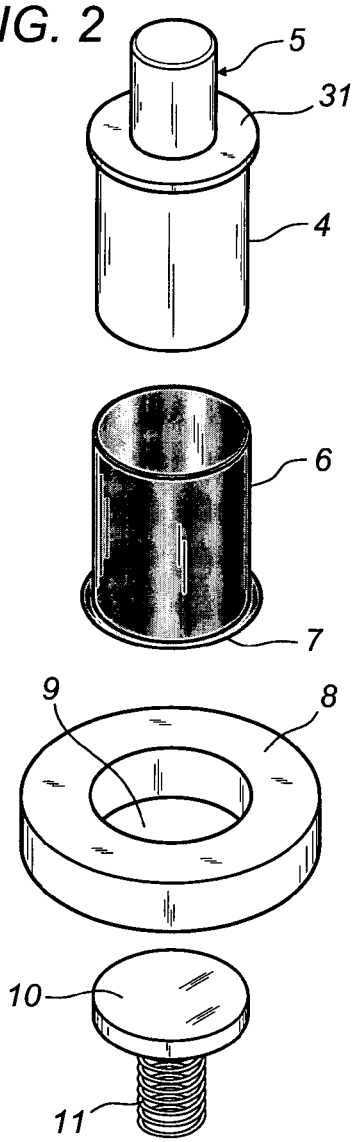
FIG. 2 is an exploded schematic view of devices in accordance with the invention for stably joining with a pre-glued disk of covering paper the base and the curvilinear wall of FIG. 1.
Figure 3:
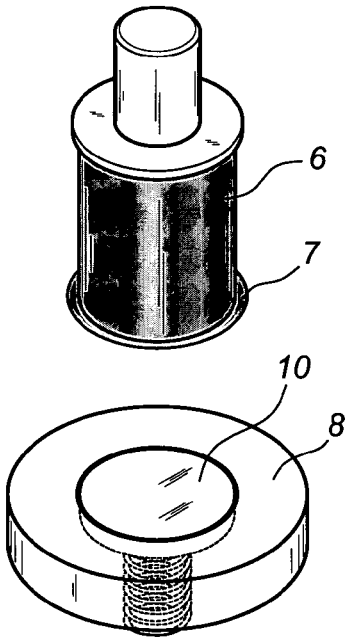
FIGS. 3 and 4 are schematic views of successive steps of the application of a pre-glued disk by the devices of FIG. 2.
Figure 4:
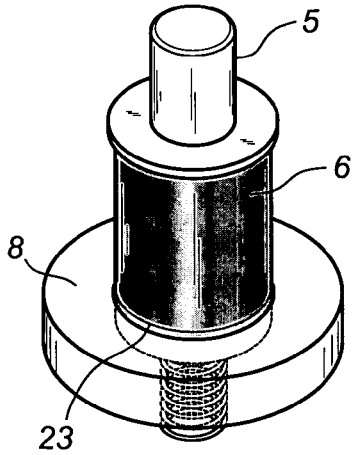

With reference to FIGS. 2-4, the bottom 2 and the wall 1 may be stably joined by applying a pre-glued disk 7 to the end 24 of the box.

Figure 9:
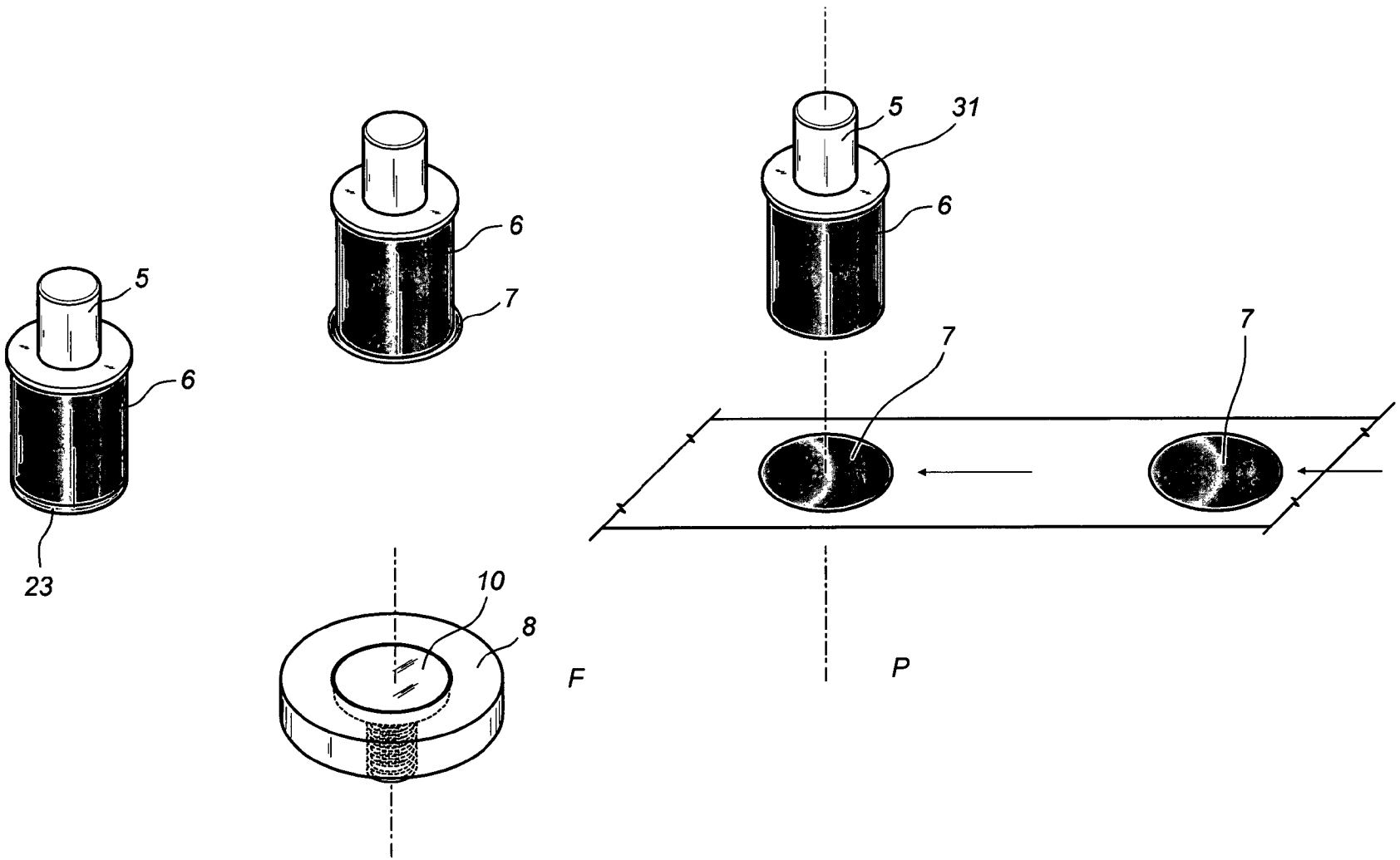
FIG. 9 is a schematic view of the step of transferring an assembled box to the aiming and forming stations.

Preferably, and with reference to FIG. 9, the disk 7 has radial dimensions slightly greater than the outer diameter of the box 6 and travels resting on a conveyor belt 27 at an aiming station P.

In the station P, the box 6 may be engaged by a gripper element 5 with vertical stroke, positioned above the pre-glued disk 7 and comprising a cylindrical body 4 which can be precisely inserted in the box 6 until contact is made with a flange 31, so as to place the box 6 centred on the disk 7 over the latter and glue it there.

In particular, the box is centred by devices which search for the position of the disk (of the known type in the sector), which having identified the position of the disk centre the box with precise vertical alignment.

Once centring is complete, the box 6 and the disk 7 are moved to a forming station F in which there is a toroidal supporting surface 8 having an opening 9 with the shape and dimensions corresponding precisely to the outer outline of the box 6.

On the opposite side to the opening 9, in the example described, there may also be a plate 10, if necessary mounted on springs 11, having dimensions such that it can be drawn near to the opening 9 in contact with the disk 7.

In operation, the box 6 with the glued disk 7 is lowered to the opening 9, and the plate 10 draws near to the non-adhesive side of the disk 7.

Continuing the box 6 stroke through the opening 9, the spring 11 yields, the bottom of the box passes through the opening 9 in a precise fashion, and the portion of the disk 7 extending beyond the opening 9 is pressed onto the stretch of wall 23 adjacent to the bottom, thus stably joining the bottom 2 and the wall 1 of the box 6.

FIGS. 5 to 8 schematically illustrate a covering station R in accordance with the invention, in which the box 6 is transferred, passing from a vertical orientation to a horizontal orientation, by tipping means able to engage the box exiting the forming station F and rotate it until it adopts a horizontal orientation, with which, after any centring or "aiming", the box 6 is received by the covering station R, if necessary passing through a magazine for boxes 6 which are not yet covered.

According to the invention, the station R is part of a carrousel unit 26 which rotates, driven by a drive unit 27 and comprises a plurality of operating stations S, at least one intended for a step of loading a formed box to be covered, and, after covering, for a finished box unloading step.

The stations S are not described in detail, as they are not themselves the subject matter of the invention.

In the example described, a box 6 already formed is being processed in a covering station R, and is already positioned on a spindle 19 mounted at the end of a carrousel 26 arm 25.

The dimensions of the spindle 19, which may be expanded on command, are such that it engages in the box 6 and can rotate about an axis 20 driven by a drive unit 14.

Figure 5:
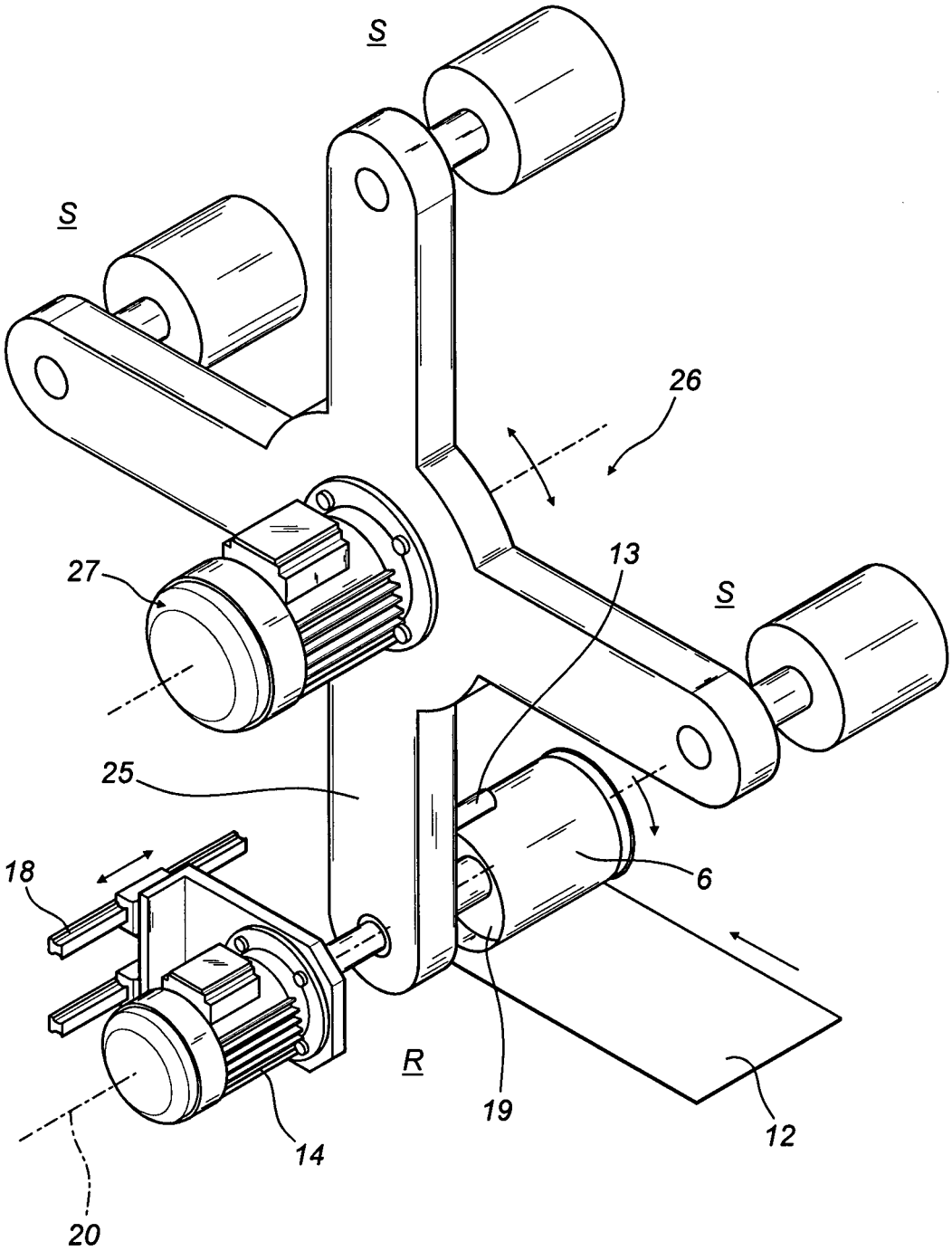
FIG. 5 illustrates a carrousel unit with a covering station in accordance with the invention.
Figure 6:
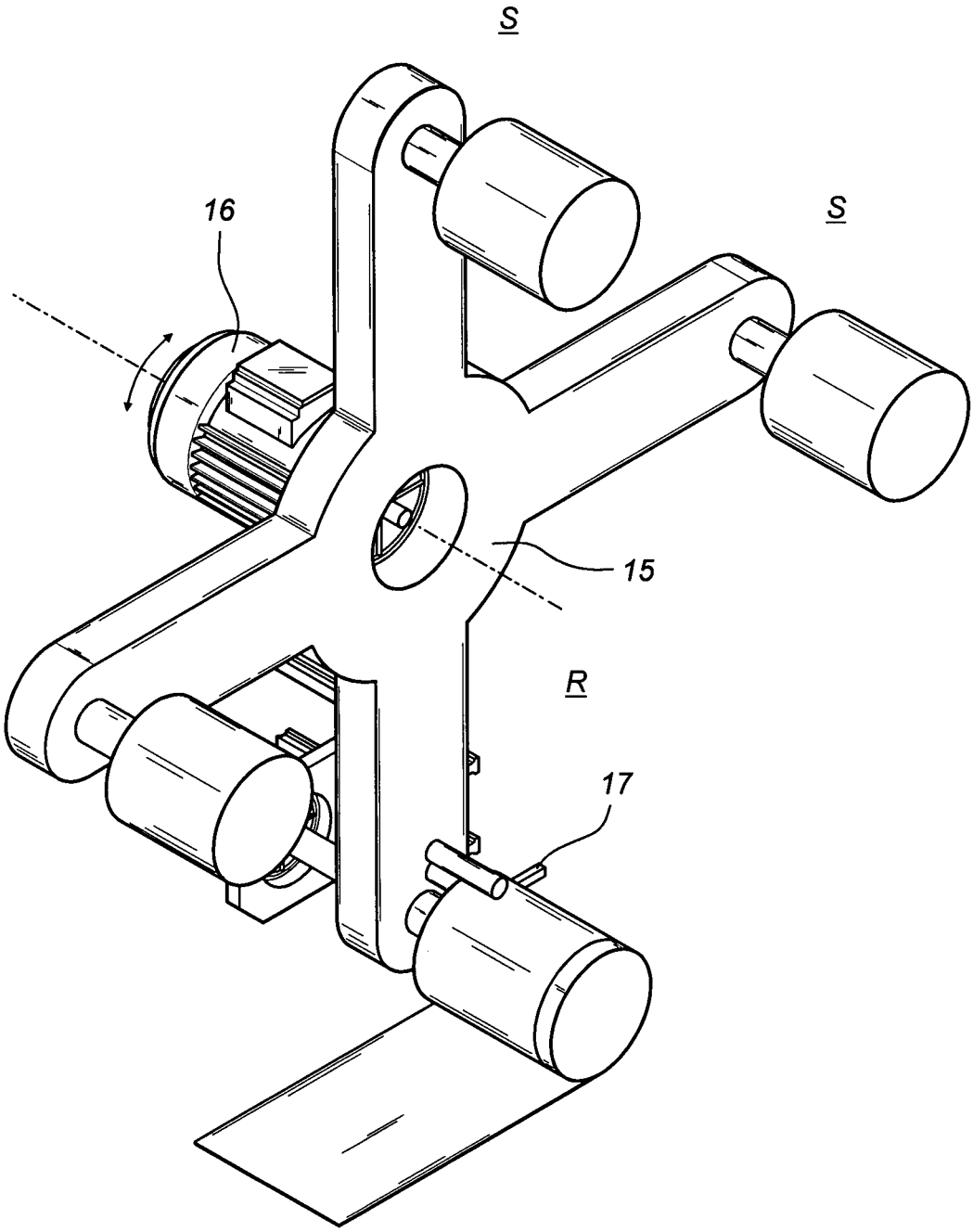
FIG. 6 shows a detail of the carrousel from FIG. 5 with a box at the covering step.

In the embodiment illustrated, the longitudinal motion of the motor 14 is guided by fixed prismatic guides 18, schematically illustrated in FIG. 5.

According to the invention, in the station R, the spindle 19 rotates the box along the axis 20 in such a way that it is synchronised with the arrival of a pre-glued covering sheet 12, fed transversally to the axis 20 until it makes contact with a box 6 generatrix along which covering takes place.

The box speed of rotation, and the sheet 12 linear feed speed are fixed so that the tip speed at the covering point coincides with the sheet 12 speed.

Alternatively, after a first sheet 12 gluing stretch on the box 6, covering may continue by dragging the sheet 12 in the absence of forced sheet feed.

The sheet 12 longitudinal extent and length are also such that it covers entire outer wall 1 and leaves an edge 22 extending beyond it at the box 6 open end 21.

It should be noticed that, in other embodiments, the sheet 12 may be fed in the form of individual pre-cut sheets, or there may be a step of cutting a continuous sheet to size.

Figure 7:
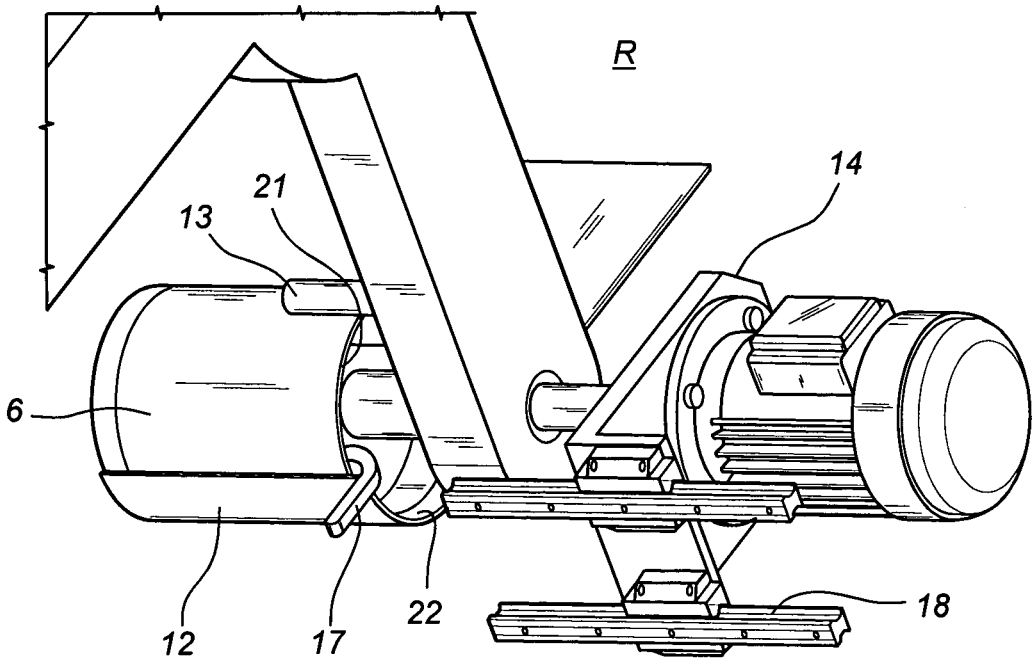
FIG. 7 shows another detail of the box covering step.
Figure 8:
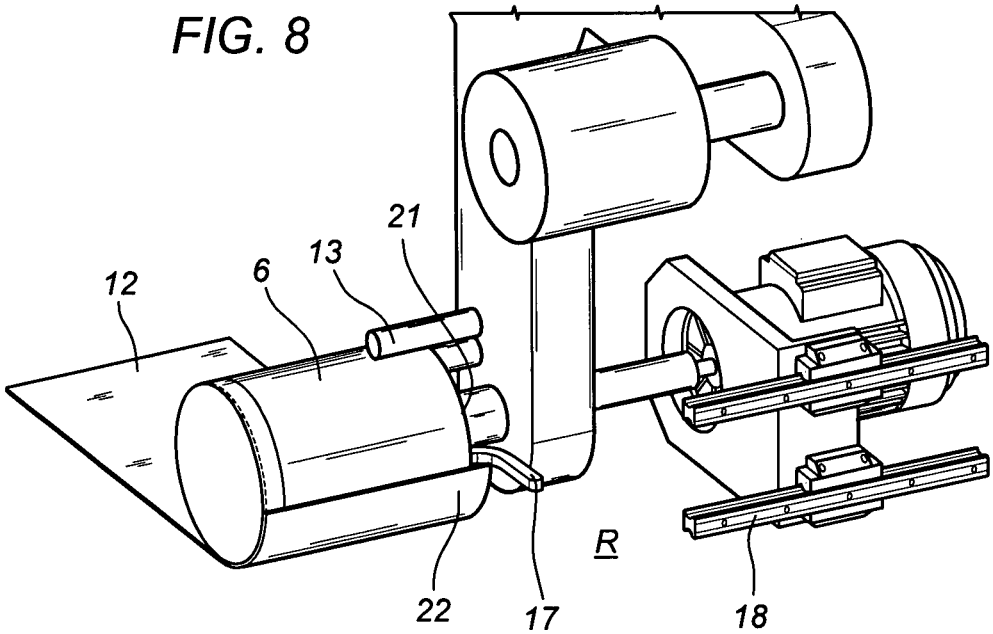
FIG. 8 shows yet another detail of the box covering step.

In particular with reference to FIGS. 7 and 8, the station R also comprises edge turning down folders 17, positioned close to the open end 21 of the box 6 to interfere with the passage of the edge 22 during box covering and guide the edge so that it folds towards the inside of the box and covers the open edge of the box.

Covering of the open end 21 is then preferably completed by a pair of pressure rollers 13 belonging to the station R, positioned straddling the end 21 to press the edge 22 against the wall 1 during box rotation.

It must be emphasised that the layout of the drive units and the guides described is by way of example, but its shall be understood that different mechanisms and mechanical solutions may be used to rotate the spindle 19 and perform the covering and edge turning down steps.

For example, in different solutions, both box covering and edge turning down may be carried out in the same station R. In such a case, there may be only one motor positioned at the station R and having a coupling with which the motor, for example by means of axial sliding, engages with and disengages from the carrousel spindle.

In a different solution there may be several motors, if necessary with hook-release coupling, positioned at several operating stations R, S of the carrousel set up to perform separate covering or edge turning down steps.

Once covering and edge turning down are complete, the finished box is moved by the carrousel away from the station R and to a subsequent unloading station S, then sent on for subsequent processing or storage.

Figure 10:
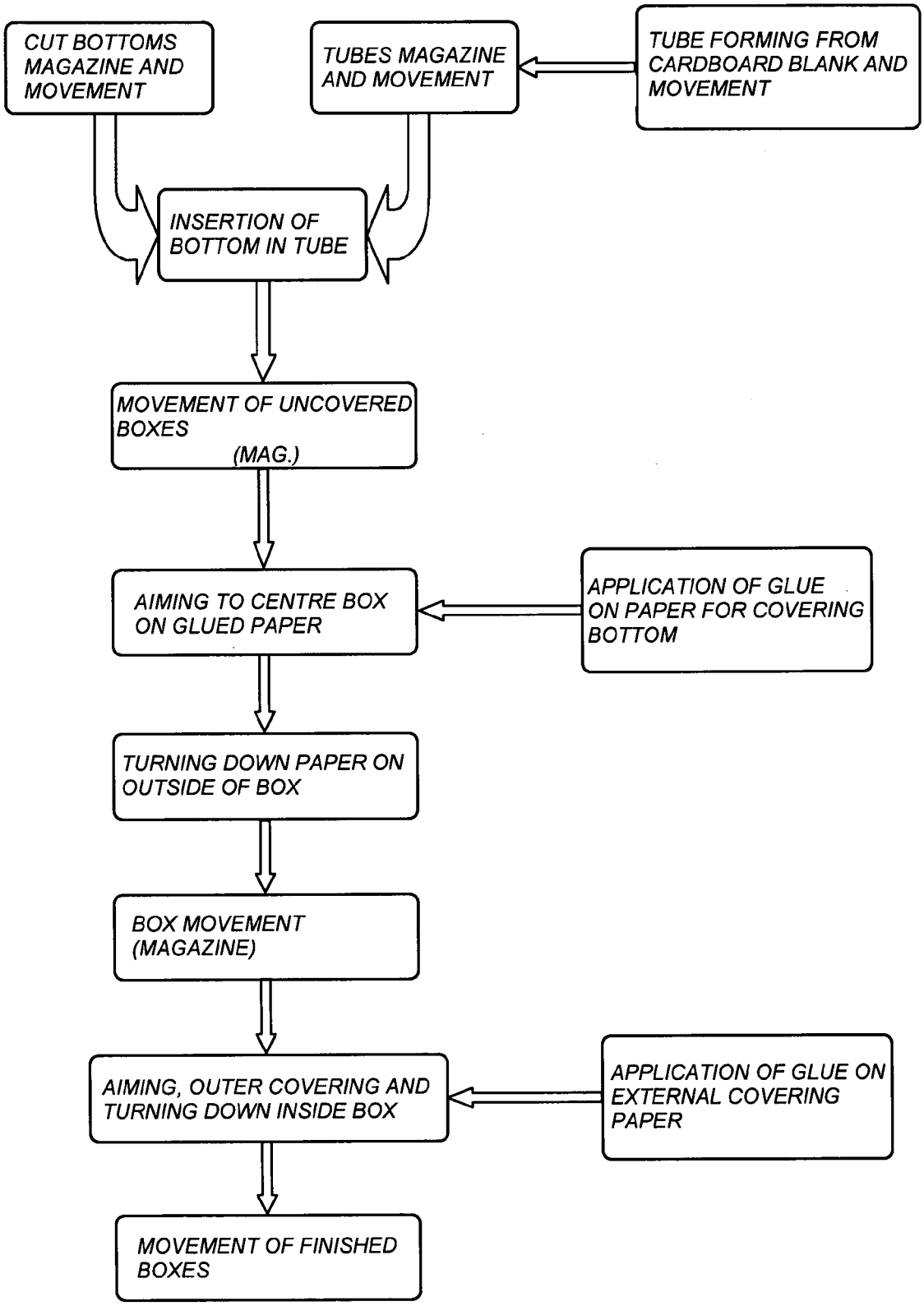
FIG. 10 shows an example of a succession of processing steps of the method in accordance with the invention.

FIG. 10 illustrates, by way of example, a sequence of the steps described above for the automatic production of covered boxes disclosed, involving:

- use of magazines for the bottoms 2 and cylindrical walls or tubes 1,
- assembly of the bottom and the wall to form the box 6,
- movement of the box 6 to the aiming station P with a pre-glued sheet 7,
- sheet 7 edge turning down on the wall 1,
- movement of the box with the bottom covered towards the station for box lateral covering with a pre-glued sheet,
- turning down the lateral covering sheet on the open edge of the wall,
- unloading with movement of the covered box.

The invention is described above with reference to a preferred embodiment, although it shall be understood that equivalent modifications may be made without it thereby departing from the scope of the inventive concept.

The invention claimed is:

1. A machine for making covered paper or cardboard boxes having a curvilinear outline, comprising:

means for forming a curvilinear box (6) having a bottom (2), stably joined to a first end (24) of a wall with a curvilinear outline (1), said box being cylindrical, means for conveying the box (6) to a covering station (R), a covering station (R) having a spindle (19), the spindle (19) having a horizontal rotation axis (20) through itself, the spindle (19) being connectable with a motor (14) so that when the spindle (19) and the motor (14) are connected, the motor (14) can drive the spindle (19) in rotation around the spindle's horizontal axis (20); the spindle (19) being able to engage in the box (6) and rotate the box (6) around the horizontal axis (20) when the spindle (19) is driven by the motor (14);

means for linear feed of a pre-glued covering sheet (12) to the covering station (R), wherein said means for linear feed operate in conjunction with the motor (14) driving the spindle (19), so as to connect the sheet (12) around the outer wall of the box (6) when the spindle (19) is driven by the motor (14) to perform a complete rotation around the spindle's horizontal axis (20), the station (R) also having means (17) for covering a second, open end (21) of the box with an edge (22) of the sheet (12) projecting from said second end.

2. The machine according to claim 1, wherein the means for forming a curvilinear box (6) comprise:

means (3) for inserting a bottom (2) whose outer outline just interferes with the inner outline of the wall (1) and positioning it at the first end of the wall (1), and means (5, 8) for applying a pre-glued disk (7) to the bottom (2) to close the first end of the wall (1).

3. The machine according to claim 2, wherein the means for inserting the bottom (2) in the wall (1) comprise a first gripper element (3) for holding and conveying the bottom (2).

4. The machine according to claim 3, wherein the means for applying a pre-glued disk comprise:

a disk supporting surface (8), having an opening (9) whose shape and dimensions match the outer outline of the box (6), a second gripper element (5) able to move relative to the surface (8), to hold and move the box (6), a contact surface (10) able to move relative to the supporting surface (8), which can be inserted through the opening (9) and is opposite the element (5) relative to the opening (9), means for moving the contact surface (10) until it is drawn near the disk (7) resting on the supporting surface (8), means for moving the second gripper element (5) until the box (6) is placed on top of a pre-glued side of the disk (7) resting on the supporting surface (8) and forcing the box (6) through the opening (9) so as to apply a peripheral portion (23) of the disk (7) to a stretch of the wall (1) adjacent to the first end (24).

5. The machine according to claim 2, wherein the means for applying a pre-glued disk comprise:

a disk supporting surface (8), having an opening (9) whose shape and dimensions match the outer outline of the box (6), a second gripper element (5) able to move relative to the surface (8), to hold and move the box (6), a contact surface (10) able to move relative to the supporting surface (8), which can be inserted through the opening (9) and is opposite the element (5) relative to the opening (9), means for moving the contact surface (10) until it is drawn near the disk (7) resting on the supporting surface (8), means for moving the second gripper element (5) until the box (6) is placed on top of a pre-glued side of the disk (7) resting on the supporting surface (8) and forcing the box (6) through the opening (9) so as to apply a peripheral portion (23) of the disk (7) to a stretch of the wall (1) adjacent to the first end (24).

6. The machine according to claim 5, wherein the contact surface (10) is supported by elastic means (11).

7. The machine according to claim 5, wherein the contact surface (10) is supported by pneumatically or hydraulically operated means.

8. The machine according to claim 5, wherein the contact surface (10) has a shape and dimensions which allow it to be placed over the end of the wall (1).

9. The machine according to claim 1, wherein the station (R) is an operating station of a rotary carrousel unit (26) equipped with a plurality of operating stations (S).

10. The machine according to claim 9, wherein the station (R) spindle (19) is mounted at one end of a carrousel (26) arm (25).

11. The machine according to claim 1, wherein the means (17) for covering a second, open end (21) of the box (6) comprise a curved element (17) in a fixed position relative to the box (6) covering motion, the position being such that it interferes with the edge (22) of the pre-glued sheet (12) in such a way as to fold the edge (22) into the box (6) and so cover the inner stretch of the wall (1) adjacent to the open end (21).

12. The machine according to claim 1, wherein the means (17) for covering a second, open end (21) of the box (6) comprise pressure rollers (13) acting to press the folded edge (22) onto the wall (1).

13. Machine according to claim 1, wherein the means for linear feed are configured to feed the pre-glued covering sheet transversally, such that the pre-glued covering sheet makes contact with a box generatrix.

14. Machine according to claim 1, wherein the spindle (19) is configured for rotating synchronized with the arrival of a pre-glued covering sheet (12).

* * * * *